US011215022B2

(12) United States Patent
Cardon et al.

(10) Patent No.: US 11,215,022 B2
(45) Date of Patent: Jan. 4, 2022

(54) CONTROLLED RELEASE OF HOSE

(71) Applicant: SCHLUMBERGER TECHNOLOGY CORPORATION, Sugar Land, TX (US)

(72) Inventors: Donald Cardon, Houston, TX (US); Harold Steve Bissonnette, Heber Springs, AR (US); Alexander Rudnik, Katy, TX (US); Dmitriy Ivanovich Potapenko, Sugar Land, TX (US); Bill DuBose, Jersey Village, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/629,992

(22) PCT Filed: Jul. 10, 2018

(86) PCT No.: PCT/US2018/041358
§ 371 (c)(1),
(2) Date: Jan. 10, 2020

(87) PCT Pub. No.: WO2019/014161
PCT Pub. Date: Jan. 17, 2019

(65) Prior Publication Data

US 2020/0157901 A1 May 21, 2020

Related U.S. Application Data

(60) Provisional application No. 62/530,651, filed on Jul. 10, 2017.

(51) Int. Cl.

| | |
|---|---|
| ***E21B 23/03*** | (2006.01) |
| ***E21B 7/18*** | (2006.01) |
| ***E21B 17/20*** | (2006.01) |

(52) U.S. Cl.
CPC ..... *E21B 23/03* (2013.01); *E21B 7/18* (2013.01); *E21B 17/20* (2013.01)

(58) Field of Classification Search
CPC . E21B 7/061; E21B 7/18; E21B 17/20; E21B 23/03; E21B 23/04; E21B 23/042; E21B 41/0035
See application file for complete search history.

(56) References Cited

U.S. PATENT DOCUMENTS

| | | | |
|---|---|---|---|
| 2,731,414 | A | 1/1956 | Binder, Jr. |
| 2,808,109 | A | 10/1957 | Kirk |

(Continued)

FOREIGN PATENT DOCUMENTS

| | | | |
|---|---|---|---|
| CN | 102504292 | A | 6/2012 |
| CN | 105349166 | A | 2/2016 |

(Continued)

OTHER PUBLICATIONS

Pinto, I.S.S. et al., "Biodegradable chelating agents for industrial, domestic, and agricultural applications—a review", Environmental Science and Pollution Research, 2014, 21, pp. 11893-11906.

(Continued)

*Primary Examiner* — Jennifer H Gay
(74) *Attorney, Agent, or Firm* — Michael L. Flynn

(57) ABSTRACT

Apparatuses and methods for positioning a flexible hose into a wellbore with a protective housing are disclosed. A flexible hose is contained within a protective housing and both are positioned into a wellbore to a desired depth. Pressure can be applied to an interior of the protective housing, and a packoff seals between the flexible hose and the protective housing, causing the pressure to eject the hose from the protective housing.

18 Claims, 7 Drawing Sheets

(56) References Cited

U.S. PATENT DOCUMENTS 3,282,337 A 11/1966 Pye
3,336,221 A 8/1967 Ralston
3,553,099 A 1/1971 Savage
3,704,750 A 12/1972 Miles
3,878,884 A 4/1975 Raleigh
3,892,274 A * 7/1975 Dill ..... E21B 37/08 166/222
4,007,797 A 2/1977 Jeter
4,032,460 A 6/1977 Zilch et al.
4,036,732 A 7/1977 Irani et al.
4,046,668 A 9/1977 Farcasiu et al.
4,046,669 A 9/1977 Blaine et al.
4,108,760 A 8/1978 Williams et al.
4,139,450 A 2/1979 Hanson et al.
4,347,118 A 8/1982 Funk et al.
4,479,541 A 10/1984 Wang
4,519,463 A 5/1985 Schuh
4,613,631 A 9/1986 Espenscheid et al.
4,640,362 A * 2/1987 Schellstede ..... E21B 7/061 166/223
4,666,683 A 5/1987 Brown et al.
4,848,486 A 7/1989 Bodine
4,977,961 A 12/1990 Avasthi
RE33,660 E 8/1991 Jelsma
5,261,489 A 11/1993 Jennings, Jr. et al.
5,335,726 A 8/1994 Rodrigues
5,358,051 A 10/1994 Rodrigues
5,373,906 A * 12/1994 Braddick ..... E21B 7/061 175/61
5,868,210 A 2/1999 Johnson et al.
5,893,416 A 4/1999 Read
6,581,690 B2 6/2003 Van Drentham-Susman et al.
7,347,260 B2 3/2008 Ferguson et al.
7,422,059 B2 9/2008 Jelsma
7,431,083 B2 10/2008 Olsen
7,441,595 B2 10/2008 Jelsma
7,686,101 B2 3/2010 Belew et al.
7,788,037 B2 8/2010 Soliman et al.
7,971,658 B2 7/2011 Buckman, Sr.
7,971,659 B2 7/2011 Gatlin et al.
8,167,060 B2 * 5/2012 Brunet ..... E21B 41/0035 175/424
8,201,643 B2 6/2012 Soby et al.
8,220,547 B2 7/2012 Craig et al.
8,372,786 B2 2/2013 Berkland et al.
8,408,333 B2 4/2013 Pai et al.
8,420,576 B2 4/2013 Eoff et al.
8,424,620 B2 4/2013 Perry, Jr. et al.
8,590,618 B2 11/2013 Jelsma
8,672,034 B2 3/2014 Al-Ajmi et al.
8,770,316 B2 7/2014 Jelsma
9,121,272 B2 9/2015 Potapenko et al.
9,567,809 B2 2/2017 Savage
9,803,134 B2 10/2017 De Wolf et al.
10,005,955 B2 6/2018 Beuterbaugh et al.
2002/0005286 A1 1/2002 Mazorow et al.
2003/0062167 A1 4/2003 Surjaatmadja et al.
2005/0056418 A1 3/2005 Nguyen
2005/0230107 A1 10/2005 McDaniel et al.
2006/0048946 A1 3/2006 Al-Muraikhi
2006/0070740 A1 4/2006 Surjaatmadja et al.
2006/0102343 A1 5/2006 Skinner et al.
2007/0261852 A1 11/2007 Surjaatmadja et al.
2007/0261887 A1 11/2007 Pai et al.
2008/0078548 A1 4/2008 Pauls et al.
2008/0135292 A1 6/2008 Sihler et al.
2008/0139418 A1 6/2008 Cioletti et al.
2009/0017678 A1 1/2009 Meier et al.
2009/0065253 A1 3/2009 Suarez-Rivera et al.
2009/0101414 A1 * 4/2009 Brunet ..... E21B 7/18 175/62
2009/0114385 A1 5/2009 Lumbye
2009/0250211 A1 10/2009 Craig
2009/0288884 A1 11/2009 Jelsma
2010/0126722 A1 5/2010 Cornelissen et al.
2010/0187012 A1 7/2010 Belew et al.
2010/0243266 A1 9/2010 Soby et al.
2010/0282470 A1 11/2010 Alberty et al.
2011/0005762 A1 1/2011 Poole
2011/0017468 A1 1/2011 Birch et al.
2011/0061869 A1 3/2011 Abass et al.
2011/0067871 A1 3/2011 Burdette et al.
2011/0068787 A1 3/2011 Freedman et al.
2011/0147088 A1 * 6/2011 Brunet ..... E21B 7/046 175/67
2012/0024530 A1 2/2012 Todd et al.
2012/0067646 A1 3/2012 Savage
2012/0160567 A1 6/2012 Belew et al.
2012/0325555 A1 12/2012 Jette et al.
2013/0000908 A1 1/2013 Walters et al.
2013/0032349 A1 2/2013 Alekseenko et al.
2013/0062125 A1 3/2013 Savage
2013/0213716 A1 * 8/2013 Perry ..... E21B 7/061 175/62
2013/0220606 A1 8/2013 Yhuel et al.
2013/0233537 A1 9/2013 McEwen-King et al.
2013/0304444 A1 11/2013 Strobel et al.
2013/0341029 A1 12/2013 Roberts et al.
2014/0096950 A1 4/2014 Pyecroft et al.
2014/0096966 A1 * 4/2014 Freitag ..... E21B 43/114 166/298
2014/0102708 A1 4/2014 Purkis et al.
2014/0144623 A1 5/2014 Pyecroft et al.
2014/0340082 A1 11/2014 Yang et al.
2015/0007988 A1 1/2015 Ayasse
2015/0096748 A1 4/2015 West
2015/0107825 A1 4/2015 Miller et al.
2015/0218925 A1 8/2015 Lecampion et al.
2015/0337613 A1 11/2015 Belew et al.
2015/0356403 A1 12/2015 Storm, Jr.
2016/0053597 A1 2/2016 Brown et al.
2016/0115772 A1 4/2016 Graham et al.
2016/0131787 A1 5/2016 Quirein et al.
2016/0153239 A1 6/2016 Randall
2016/0215581 A1 7/2016 Ingraham et al.
2016/0281480 A1 9/2016 Pyecroft et al.
2016/0312587 A1 10/2016 Montaron et al.
2017/0030180 A1 2/2017 Maurer
2017/0204713 A1 7/2017 Bell et al.
2018/0023375 A1 1/2018 Potapenko et al.
2018/0112468 A1 4/2018 Savage et al.
2018/0163122 A1 6/2018 Panga et al.
2018/0306017 A1 10/2018 Savage
2018/0328118 A1 11/2018 Morse et al.
2019/0017358 A1 1/2019 Morse et al.
2020/0157901 A1 * 5/2020 Cardon ..... E21B 23/03

FOREIGN PATENT DOCUMENTS

EP 2631422 A2 8/2013
EP 2672409 A2 12/2013
EP 2198119 B1 10/2017
GB 2406863 A 4/2005
WO 9113177 A1 9/1991
WO WO-9420727 A1 * 9/1994 ..... E21B 7/061
WO 0046484 A1 8/2000
WO 03050377 A2 6/2003
WO 2004046494 A2 6/2004
WO 2005090747 A1 9/2005
WO 2009096805 A1 8/2009
WO WO-2009157812 A1 * 12/2009 ..... F04F 5/54
WO 2013019390 A1 2/2013
WO 2015089458 A1 6/2015
WO 2016138005 A1 9/2016
WO 2017074722 A1 5/2017
WO 2017078989 A1 5/2017
WO 2018049311 A1 3/2018
WO 2018049367 A1 3/2018
WO 2018049368 A1 3/2018
WO 2018129136 A1 7/2018
WO 2019014160 A1 1/2019
WO 2019014161 A1 1/2019
WO 2019168885 A1 9/2019

(56) References Cited

FOREIGN PATENT DOCUMENTS

| | | | |
|---|---|---|---|
| WO | 2019241454 | A1 | 12/2019 |
| WO | 2019241455 | A1 | 12/2019 |
| WO | 2019241456 | A1 | 12/2019 |
| WO | 2019241457 | A1 | 12/2019 |
| WO | 2019241458 | A1 | 12/2019 |

OTHER PUBLICATIONS

Alekseenko, O. P., Potapenko, D.I., Cherny, S.G., Esipov, D.V., Kuranakov, D.S., Lapin, V.N. "3-D Modeling of fracture initiation from perforated non-cemented wellbore", SPE J., vol. 18, No. 3, 589-600, 2013.

Alekseenko O.P., Potapenko D.I. , Kuranakov D.S., Lapin V.N., Cherny S.G., and Esipov D.V. "3D Modeling of Fracture Initiation from Cemented Perforated Wellbore", presented at 19th European Conference on Fracture, Kazan, Russia, Aug. 26-31, 2012.

Potyondy, "Simulating stress corrosion with a bonded-particlle model for rock", International Journal of Rock Mechanics and Mining Sciences, vol. 44, Issue 5, Jul. 2007, pp. 677-691. https://www.sciencedirect.com/science/article/pii/S1365160906001560.

Atkinson et al., "Acoustic Emission During Stress Corrosion Cracking in Rocks", Earthquake Predition: An International Review, vol. 4, pp. 605-616, 1981. https://agupubs.onlinelibrary.wiley.com/doi/pdf/10.1029/ME004p0605.

Wikipedia.org, "Wood's metal", edited May 4, 2019, Accessed Jul. 3, 2019; https://en.wikipedia.org/wiki/Wood%27s_metal.

* cited by examiner

CONTROLLED RELEASE OF HOSE

BACKGROUND

Radial drilling is used to drill small-diameter horizontal wellbores. With this coiled tubing conveyed drilling technique, new wellbores are drilled perpendicular from the mother bore and into the reservoir formation. In a cased wellbore, a special cutting bottom hole assembly (BHA) is used to drill a hole in casing. This BHA is run through a jointed tubing workstring equipped with a deflector shoe that points sideways into casing when lowered downhole. The cutter BHA consists of a downhole positive displacement motor, a flexible driveshaft and a drill bit. The flexible driveshaft is designed to bend inside a short-radius curvature channel in the deflector shoe, transmit the force and torque from the PDM to the drill bit.

After the flexible drive shaft and mill have pierced a hole thru the casing and begun to create a new channel often called a radial wellbore or radial channel or radial arm from the mother wellbore—a variety of techniques could be used to extend this radial wellbore.

One of the techniques that could be used is to extend the wellbore with a hydraulic drilling method. In this method hydraulic horsepower is delivered to a nozzle that is fed through the deflector shoe and to the point where the flexible shaft and/or mill stopped progressing. Sufficient hydraulic power to cut into formation and extend the shaft is supplied to the nozzle and the nozzle is moved further into the wellbore cutting forward with hydraulic power.

FIG. 1 is an illustration of a radial jet drilling assembly according to the prior art. Radial jet drilling has been used to create a radial arm in formation rock from a mother well. In this arrangement a flexible hose is conveyed into a wellbore by gravity. The flexible hose, often approximately 300' in length, is attached to a more rigid steel tubing. Generally the formation rocks are relatively shallow so the rigid steel tubing is small in size relative to conventional coiled tubing (often approximately ⅝" size). The flexible hose is attached to this rigid steel tubing and lowered into the wellbore such that gravity can allow the hose to fall axially to the start of the diverter shoe (deflecting shoe in FIG. 1). The hose has a nozzle head that can direct high pressure jets into the formation rock and cut thru that formation creating a channel. In most instances the nozzle head itself is "self-propelled," meaning there is more flow directed backward away from the front of the radial hole compared to forward. Thus the net momentum of the fluid jets creates a force that helps drive the nozzle forward/radially into the formation.

A propulsion method is often necessary when attempting to reach extended depths within a non-vertical wellbore. Use of larger diameter tubing with greater relative stiffness is often utilized to offset a portion of the mentioned propulsion requisite. Flexible objects which are far less rigid in nature such as a hose connected to the distal end of coiled tubing will often require a propulsion method which imparts tension to and assists the less rigid objects along the well trajectory. In the scenario of attaching a flexible hose to the end of a conventional coiled tubing string, the hose itself can become entangled or damaged while conveying to the bottom of a long or tortuous wellbore. To overcome this the end of the hose is fitted with rubber/flexible cup elements as shown in FIG. 2. With the cup elements resting on the bottom of the flexible hose fluid can be pumped into the wellbore in the annular space between the coiled tubing and the mother wellbore such that there is a pressure drop as that fluid passes over the flexible rubber cups. This pressure drop keeps the flexible hose in tension below coiled tubing. Maintaining tension on the flexible hose despite conveying that hose into a deviated wellbore is advantageous because as long as tension is maintained on the hose by means of pumping over cups or (any other upset) the hose is far less likely to be damaged during the conveyance process.

SUMMARY

Embodiments of the present disclosure are directed to an apparatus including a flexible hose configured to be used in a jet drilling operation in a wellbore, and a protective housing configured to encase and protect the flexible hose. The protective housing having a first interior diameter and a second interior diameter larger than the first interior diameter. The apparatus also includes a collet having an expandable portion movable from a retracted position in which the nose of the flexible hose cannot exit the collet and an expanded position in which the nose of the flexible hose is permitted to exit the collet. The first interior diameter of the protective housing holds the expandable portion of the collet in the retracted position and the second interior diameter permits the collet to move to the expanded position. During running in hole the collet is in the retracted position with the hose within the collet and wherein selectively applied pressure moves the collet to the expanded position and the hose is permitted to exit the collet.

Further embodiments of the present disclosure are directed to a method of running a flexible hose into a wellbore. The method includes positioning a flexible hose in a wellbore within a packoff, wherein the packoff is within a housing, the flexible hose having a first portion above the packoff and a second portion below a packoff, the packoff forming a seal around an exterior of the flexible hose. The housing comprises a hose retainer configured to release the hose axially when the hose retainer reaches a predetermined location in the well. The method also includes providing pressure to the first portion such that the flexible hose is moved down into the wellbore until the flexible hose reaches the predetermined location in the well, and releasing the flexible hose from the hose retainer. The method also includes pumping fluid through the flexible hose whilst controlling, limiting and/or mitigating flow dispensed from deployment housing along the exterior of the hose as the hose is dispensed from the housing.

In other embodiments, the first portion includes a hose head assembly having a selectively closable opening, fluidly coupled to the flexible hose. If pressure is below a threshold pressure, fluid is permitted to enter the flexible hose through the selectively closable opening, and if pressure is greater than the threshold pressure the selectively closable opening is closed. The method also includes selectively applying pressure to open or close the selectively closable opening.

In further embodiments, the present disclosure is directed to an apparatus including a housing having a hose ejection site and a plurality of collars, and a hose assembly. The hose assembly includes a nose at a distal end, a flexible body having an interior bore coupled to the nose, a hose retainer being configured to release the nose from the hose retainer upon reaching the hose ejection site, and a packoff coupled to the flexible body and being configured to fit within the housing, the flexible body extends through the packoff. The apparatus also includes a hose head assembly coupled to the flexible body at a proximal end, the hose head assembly comprising a selectively openable aperture that is biased into an open position in which fluid enters the hose head assembly and the flexible body. The hose head assembly has an outer diameter substantially equal to an interior diameter of the collars. The outer diameter forms a seal with the collars. The seal causes the selectively openable aperture to close. When the selectively openable aperture is closed pressure can be selectively applied to the hose head assembly sufficient to overcome the seal and to move the hose head assembly past the collars.

DETAILED DESCRIPTION

Below is a detailed description according to various embodiments of the present disclosure. Embodiments of the present disclosure are directed to systems and method for advancing a flexible hose forward and downward into a wellbore including storing the hose inside a housing and ejecting the hose from the housing once the assembly has made contact with a diverter shoe as will be shown and described herein.

Aspects of the present disclosure are directed to the following systems, components, and methods as shown and described herein including a protective housing that can hold a flexible hose inside it during conveyance into a wellbore. Other embodiments are directed to a method of protecting a flexible hose from buckling, abrasion, kinking, or crushing while it is being conveyed into a wellbore. Other embodiments are directed to hardware and associated methods for retaining a flexible hose inside a protective housing until a pre-determined buildup of pressure or force is exerted on the housing or an adjacent assembly. In other embodiments the hardware is configured to exert an axial force on a flexible hose to eject it from a protective housing to propel it forward from the housing in a pre-determined direction. In yet other embodiments the present disclosure is directed to a method of controlling the axial force that is exerted on the flexible hose while it is being ejected from a protective housing. Further embodiments of the present disclosure are directed to a method of determining the extent of extraction of a hose from a protective housing, and a method of determining the rate of penetration of the end of a flexible hose into a wellbore. In some embodiments the components and method of exerting torsional load on a flexible hose to rotate it while it is ejected from a protective housing are disclosed. In other embodiments the present disclosure is directed to components and methods of resisting the axial advance of a device (flexible hose) with a constant resistance force of a known magnitude. Other embodiments are directed to hardware and associated methods of attaching and aligning a housing to a diverter shoe or other device inside a wellbore.

Figure 1:
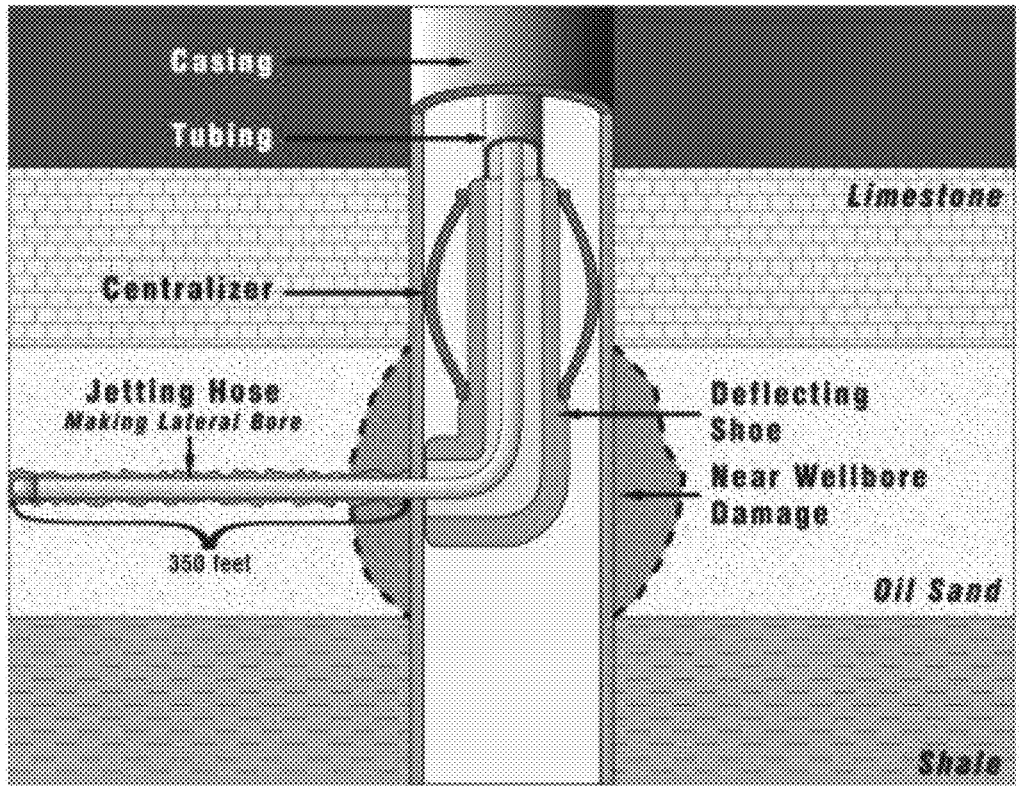
FIG. 1(PRIOR ART)
FIG. 1 is an illustration of a radial jet drilling assembly according to the prior art.
Figure 2:
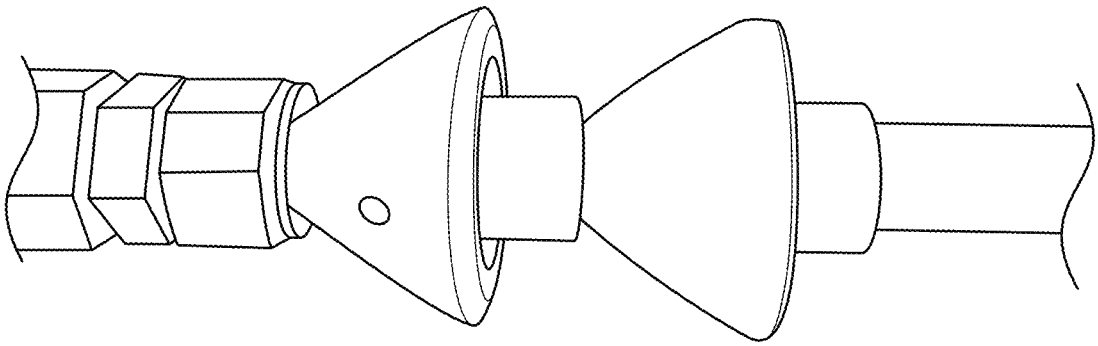
FIG. 2(PRIOR ART)
FIG. 2 shows flexible cups to be fitted onto the bottom of a flexible hose according to the prior art.
Figure 3:
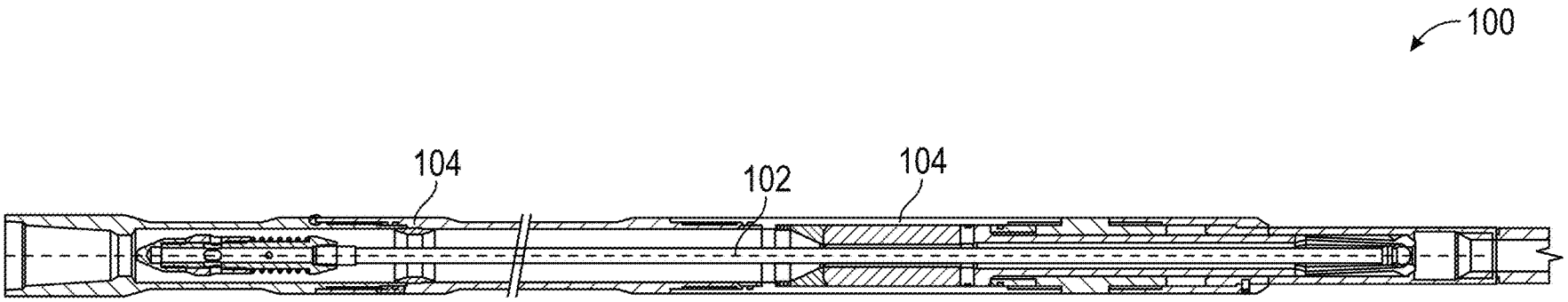
FIG. 3 is a cross-sectional view of a protective housing and flexible hose system according to embodiments of the present disclosure.

FIG. 3 is a cross-sectional view of a protective housing and flexible hose system 100 according to embodiments of the present disclosure. The system 100 includes a flexible hose 102 installed inside a tubular housing 104. The tubular housing 104 can be steel, PVC, aluminum, fiberglass, or any other suitable material. The housing 104 protects the flexible hose 102 during conveyance downhole into a wellbore. The housing 104 can be formed of several sections of strong housing sections. The housing 104 also ensures that fluid pumped from the surface is directed into the flexible hose 102 so that hydraulic jet drilling at the end of the flexible hose 102 can take place. The housing 104 allows the hose 102 to be selectively ejected from the housing 104 after a predetermined force and/or pressure has been exerted on certain components. The system 100 also includes a packoff 103 that fills the space between the housing 104 and the hose 102. The system 100 also includes a hose head assembly 105 that is configured to allow the hose head to protrude from the housing 104 at a precisely determined time and place and under specific pressure conditions. The hose head assembly 105 will be described in greater detail below. The system 100 also includes a jet nozzle and hose retainer collet that will also be described in greater detail below.

Figure 4:
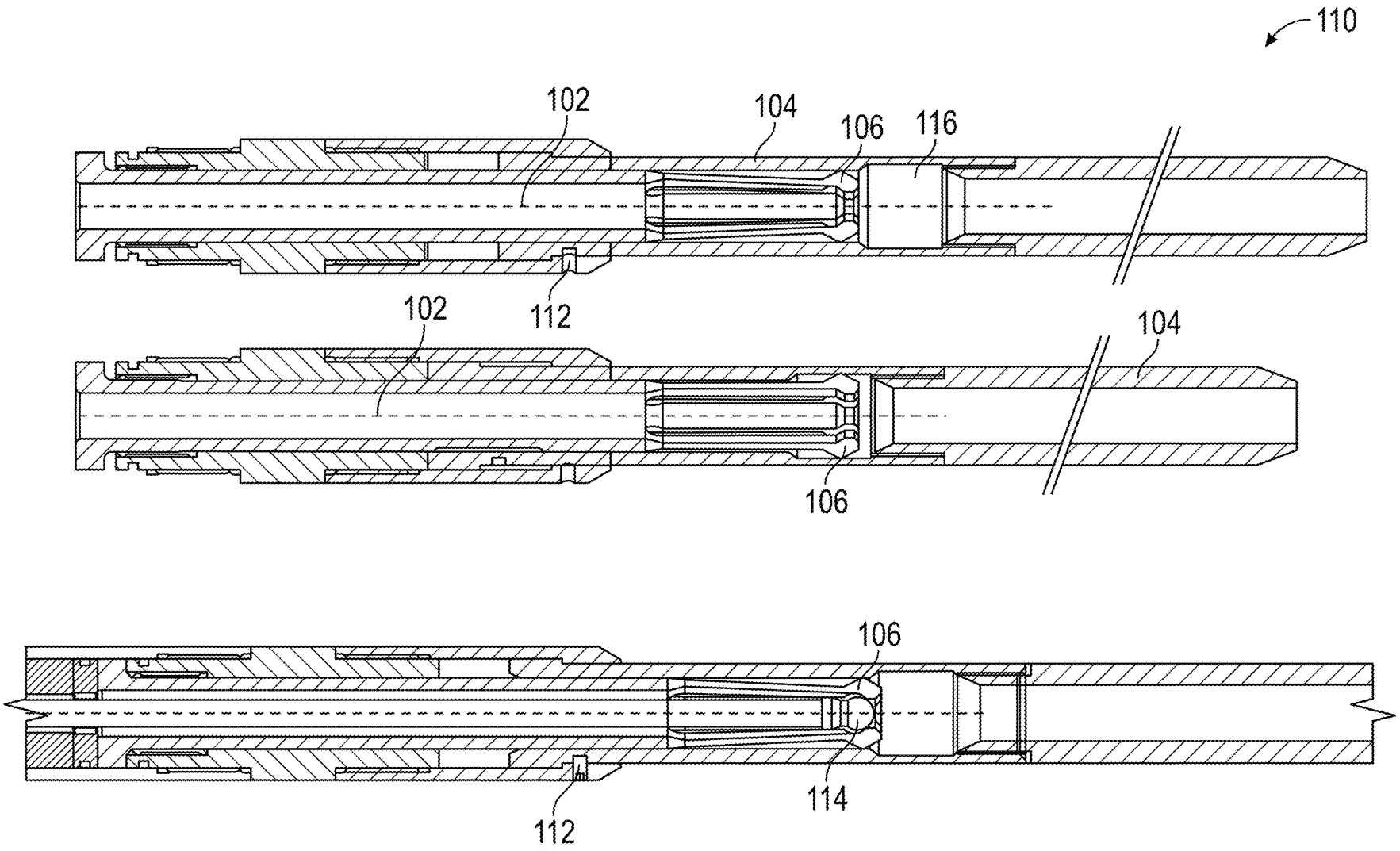
FIGS. 4A-C are a cross-sectional illustrations of a tag-up hose release system including a housing and a collet according to embodiments of the present disclosure.

FIGS. 4A, 4B, and 4C are a cross-sectional illustrations of a tag-up hose release system 110 including a housing 104 and a collet 106 according to embodiments of the present disclosure. FIG. 4A shows the system 110 with the collet 106 in a retracted position with the fingers constrained by the housing 104. The tag up hose release 110 includes a collet 106 that retains the flexible hose 102 and a shear screw 112 that prevents the collet from expanding to allow the hose to exit. The shear screw 112 can be sheared when the end of the system 110 is tagged onto (or run into) a solid obstruction. The hose 102 has a nose 114. FIG. 4B shows the system 110 in an expanded position with the collet 106 expanded. The nose 114 and the housing just above the nose 114 will telescopically move upward into the enlarged OD housing 116 once the force required to shear the shear screw 112 is applied to the end of the nose 114. Before the nose is moved upward, the collet 106 is prevented from expanding radially outward by housings that are a tight fit to the outside surface of the collet 106. Once the nose 114 moves upward into the larger housings 116 (by shearing the shear screw 112) the outside surface of the collet 106 is inside an expanded space so that it can flex radially outward. By applying sufficient force to the hose to push the collet 106 radially outward the flexible hose 102 is free to move axially out of this protective housing 110. FIG. 4C shows the system 110 in the retracted position with the hose 102 in the housing 104. The nose 114 of the hose can be a jet nozzle and abuts the collet 106. Moving the collet forward into the larger housings 116 allows the hose to protrude from the housing 104.

In other embodiments the collet 106 has an inward bias which causes the fingers to define an opening that is small enough to provide some resistance onto the hose assembly. The collet 106 can be opened by sufficient pressure applied to the hose or by a mechanical opening means. The collet 106 can be run on to a hard surface with sufficient shape and rigidity to permit the selective opening of the collet fingers 106 to permit the hose to extend beyond the collet 106.

The contact angle on the inside surface of the collet 106 and the end of the flexible hose 102 can be adjusted so that more or less radial force is generated for a given axial force. By this means the axial force required to begin ejection of the hose can be controlled. The thickness and shape of the collet fingers can also be adjusted so that more or less radial force is required to expand it and allow the ejection process to begin. The amount of axial force applied to the hose 102 can be controlled by controlling the pressure that is applied from the surface to the system 110. The strength of the shear screw 112 can be adjusted so that the set down weight on the nose of the assembly can be controlled and no ejection of the hose 102 (hence no expansion of the collet 106) can take place until that set down weight is applied from surface, thereby achieving selective, deliberate ejection of the hose 102 from the housing 110. In some embodiments the hose 102 is ejected by applying fluid pressure into the hose 102 which causes the hose to move the collet 106 forward, releasing the hose. In other embodiments a mechanical pressure or movement can urge the collet 106 forward to free the hose.

Figure 5:
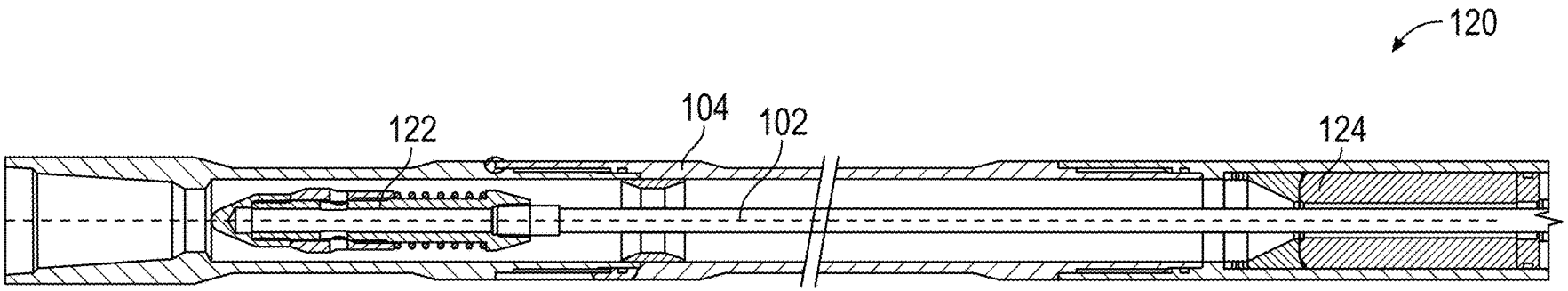
FIG. 5 is a cross-sectional view of a pack off and hose head assembly according to embodiments of the present disclosure.

FIG. 5 is a cross-sectional view of a pack off and hose head assembly 120 according to embodiments of the present disclosure. The assembly 120 includes a hose 102 and a housing 104, a hose head assembly 122 and a packoff 124. The packoff 124 can be a sealing element that blocks fluid flow through an annular region around the hose. Various types of elements can be used to achieve this. For clarity these are referred to herein as packoffs. The hose 102 is at rest inside the housing 104 can be ejected from the housing 104 by pumping into the housing 104 if the fluid that is pumped into the housing is prevented from easily escaping over the hose by the packoff 124. The packoff 124 fills the annular space between the outside surface of the hose 102 and hose head assembly 122 and the inside surface of the housings 104. When fluid is pumped into the top of the housing 104 it will be choked off at the packoff 124 and forced inside the hose head 122 and into the hose 102 where it can only exit at the nozzle at the other end of the hose (to the right; not shown in FIG. 5). The packoff 124 can be sized such that excessive friction is not developed between the hose 102 and the inside surface of the packoff 124. If the friction is too excessive, the hose 102 will not be ejected. If the friction is too low, the hose 102 might be ejected with too much force. The net force is the difference between the hydraulic ejection force and a packoff friction force. The hydraulic ejection force is approximately equal to the primary inlet pressure (usually supplied by a pump outside the hose ejection system) multiplied by the full area of the hose from the OD to the center.

$$F=PA$$

F is the force, P is the inlet pressure, and A is the full hose area. The friction force can be limited and does not exceed that ejection force and can also be prevented from becoming so low that the ejection force is too excessive and damages the hose 102.

Figure 6:
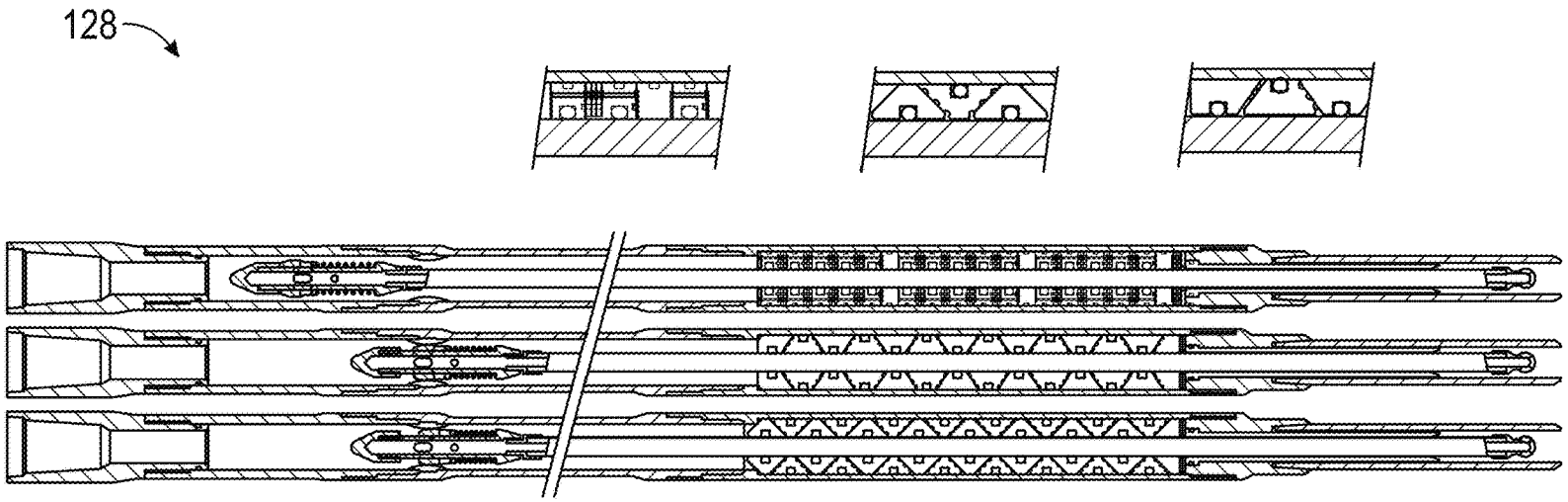
FIG. 6 is a cross-sectional view of several embodiments of labyrinth type packoff seals according to embodiments of the present disclosure.

FIG. 6 is a cross-sectional view of several embodiments of labyrinth type packoff seals 128 according to embodiments of the present disclosure. Because the packoff 124 is able to squeeze into the hose 102 and may generate excessive friction, in other embodiments a labyrinth type seal for a packoff can be used. The labyrinth seal has less friction. The labyrinth seals 128 can be designed with all-steel elements such that the packoff 124 itself does not squeeze into the hose 102 because the steel allows the seals to maintain their interior diameter even when pressure is applied to the seal 128. In the labyrinth type packing arrangement shown in FIG. 6, the all-rubber packoff 124 of FIG. 5 is replaced by steel elements that force the fluid that is being used to eject the hose thru a lengthy pathway that generates high pressure even when only a small amount of fluid meanders thru the lengthy pathway. In some embodiments almost all (typically over 95%) of the pumped fluid is forced into the hose 102 and only a small amount weeps across the labyrinth path. The friction between the hose 102 and the labyrinth seal 128 does not increase as dramatically as with an all rubber packing system.

The pressure build up above the labyrinth seal 128 will exert a force on the hose 102 proportional to the pressure multiplied by the area defined by a disc sized to the outside diameter of the hose 102. This force can be substantial and will eject the hose 102 rapidly. A means of controlling (increasing or reducing) the amount of net axial force on the hose is useful because if the force is too excessive the hose may be damaged. Excessive axial force could push the hose 102 too hard against the end of the channel that is being formed and cause damage. Likewise if the axial force is not adequate the hose 102 will not overcome friction and will not progress axially.

Figure 7:
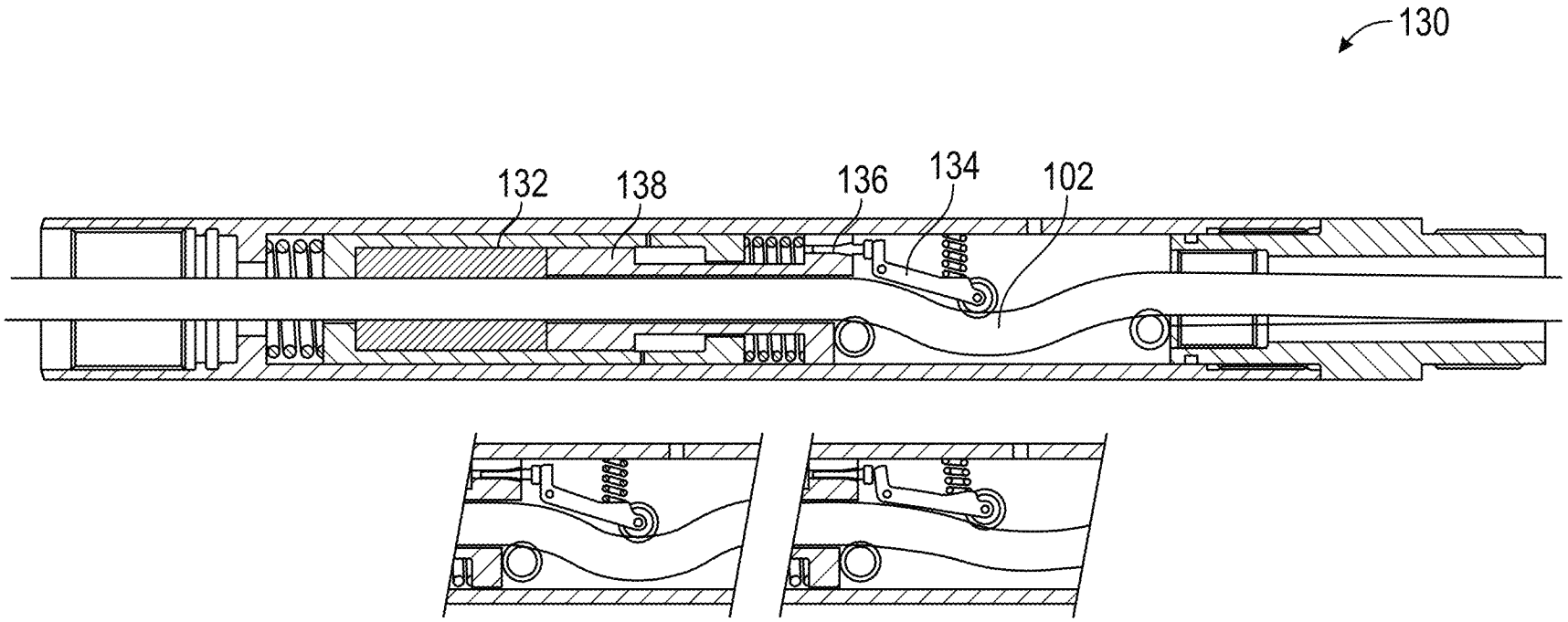
FIG. 7 is a cross-sectional view of a system for regulating axial force on a hose ejection portion of protective housings according to embodiments of the present disclosure.

FIG. 7 is a cross-sectional view of a system 130 for regulating axial force on a hose ejection portion of protective housings 132 according to embodiments of the present disclosure. The system 130 includes a hose 102, a spring-loaded roller 134, a packoff 138, and a valve 136. If the hose 102 is in compression it will be bent in the open section where the spring loaded roller 134 is located. The spring-loaded roller 134 can be connected to a valve 136. The valve 136 allows fluid to bleed from the backside of the packoff 138 if it is open, and not if it is closed. The spring-loaded roller 134 contacting the hose 102 can pivot the valve 136 to open position when the hose is in compression and closed position when the hose is in tension. An open bypass relief valve will bleed the back side of the packoff 138 and thus the packoff 138 itself will have high differential pressure across it. When the packoff 138 has higher differential pressure the packoff 138 itself grabs the hose harder so friction force on the hose 102 increases. A closed bypass relief valve will allow more pressure to build up on the back side of the packoff 138 and thus the packoff 138 itself will have less differential pressure thereby exerting less friction force on the hose 102. The net force acting on the hose 102 is the difference between the hydraulic ejection force and the packoff friction.

Thus if the hose ejection force remains constant (this is normally true in that the hydraulic force to eject the hose is the product of pressure at the inlet to the hose and the full cross-sectional area defined by the OD of the hose 102) then the system 130 reduces the net force on the hose 102 when it is in compression and increases the net force on the hose 102 when the hose 102 is in tension below it.

In this configuration the self-propelled aspect of the nozzle head on the hose 102 is the only means of generating tension in the hose 102 below the packoff 138. Thus a compressed or buckled hose will have less net force thrusting it forward (which will protect it from buckling). Conversely a hose 102 that is pulling itself forward will have a high net force pushing it forward.

Figure 8:
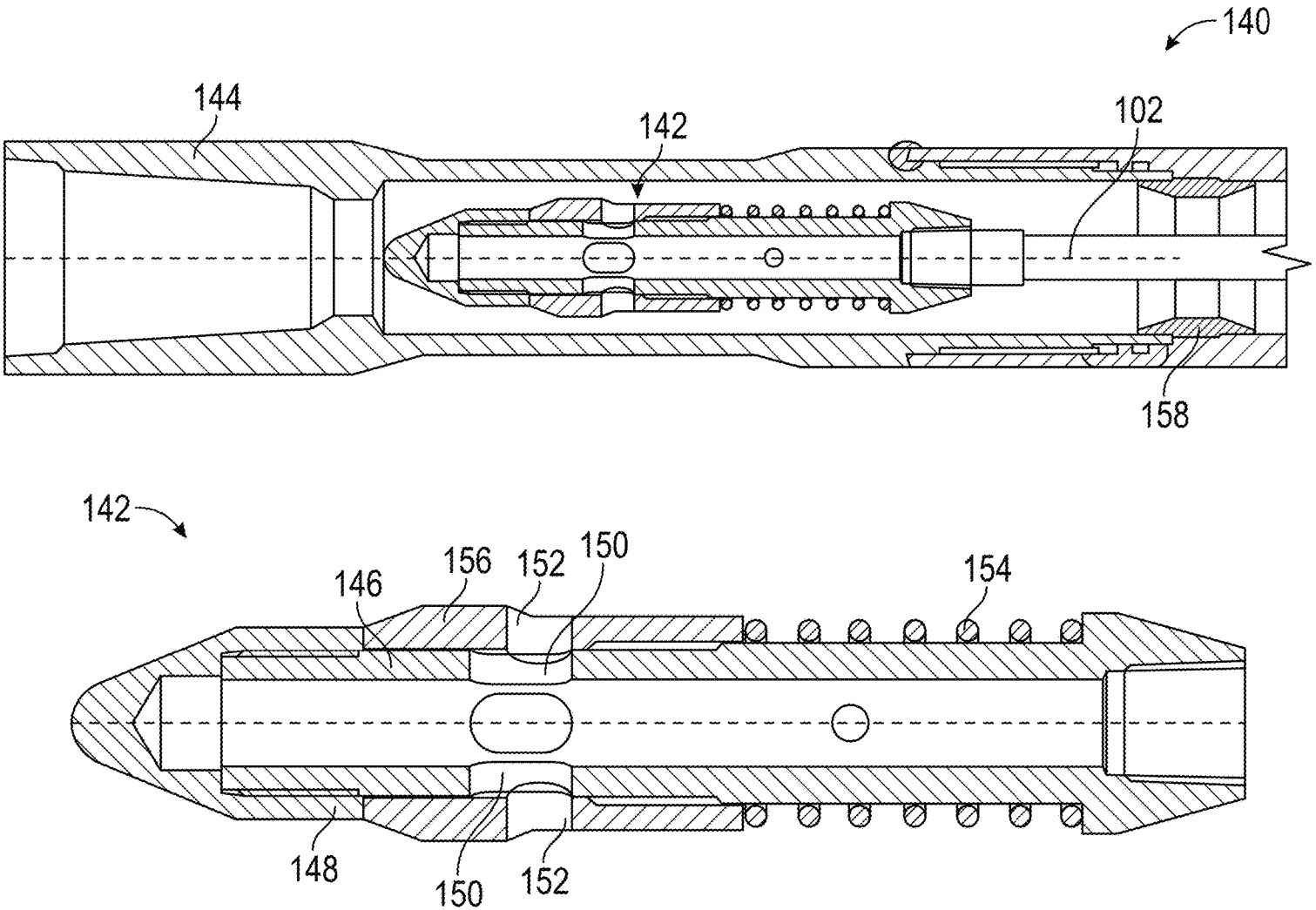
FIG. 8 is a cross-sectional illustration of a hose head assembly including a hose head and a housing according to embodiments of the present disclosure.

FIG. 8 is a cross-sectional illustration of a hose head assembly 140 including a hose head 142 and a housing 144 according to embodiments of the present disclosure. The lower figure shows the hose head 142 in greater detail. The assembly 140 includes a flexible hose 102, and a hose head 142 having an inner portion 146 and an outer portion 148 (a.k.a. a sliding sleeve). The inner portion 146 has radial holes 150 and the outer portion 148 has radial holes 152. The inner portion 146 can slide axially within the outer portion 148. A return spring 154 urges the inner portion 146 out of the outer portion 148. Fluid can be diverted into the flexible hose 102 through the hose head 142. The outer portion 148 has a thickest region 156, and the housing 144 has a collar 158 which can be narrower than other portions of the housing 144. There can be multiple collars 158 spaced apart through the housing 144. When the thickest region 156 is not immediately inside the collar 158, the fluid pathway into the hose 102 itself is unobstructed, permitting flow to enter the hose head assembly 142 through the aligned radial holes 150, 152. When the hose head 142 is aligned with the collar 158, a pressure build up will occur as the flow is obstructed for two reasons. First, the pressure will build above the hose head assembly 142 itself; and second, the outer portion 148 will experience a net force such that it will compress the return spring 154 and bring the radial holes 150, 152 out of alignment, blocking or at least inhibiting the radial entry path. This will temporarily stall the fluid entry into the hose head assembly 142 and a subsequent pressure spike will result if the pump supplying the pressure is kept at constant throttle. Each time a pressure spike is observed it can be concluded that the hose head assembly 142 has encountered another collar 158 which can be spaced apart at a predetermined distance.

Since the spacing between the collars 158 can be known in advance, and each time the hose head assembly 142 passes into a collar 158, a pressure spike gives the rate of travel as well as the distance traveled. The distance between collars 158 divided by the time between pressure spikes is equivalent to the rate of advancement of the hose assembly 142.

In another embodiment with reference to FIG. 8, the outer portion 148 must pass through tubing. As the hose head assembly 142, including the outer portion 148, passes through that tube, the tube will be swaged outward but also provide a constant resistance force opposing the hydraulic ejection force. By varying the wall thickness of the tube, and the OD of the hose head assembly 142, the force to push the hose head assembly 142 through the tube can be controlled. Thus, this arrangement could be used with a lower friction packoff such that the net force on the hose 102 is not defined by friction at the packoff. A low friction packoff can be used and the net force on the hose 102 at a given inlet pressure can still be made arbitrarily low by adjusting the swage force (controlling radial wall size of aluminum tubing and interference magnitude to the hose head). In some embodiments it can be beneficial to ensure the tube does not have differential pressure acting on it so weep holes can be drilled into it and an alternative inlet to the head above the tube could be included.

Figure 9:
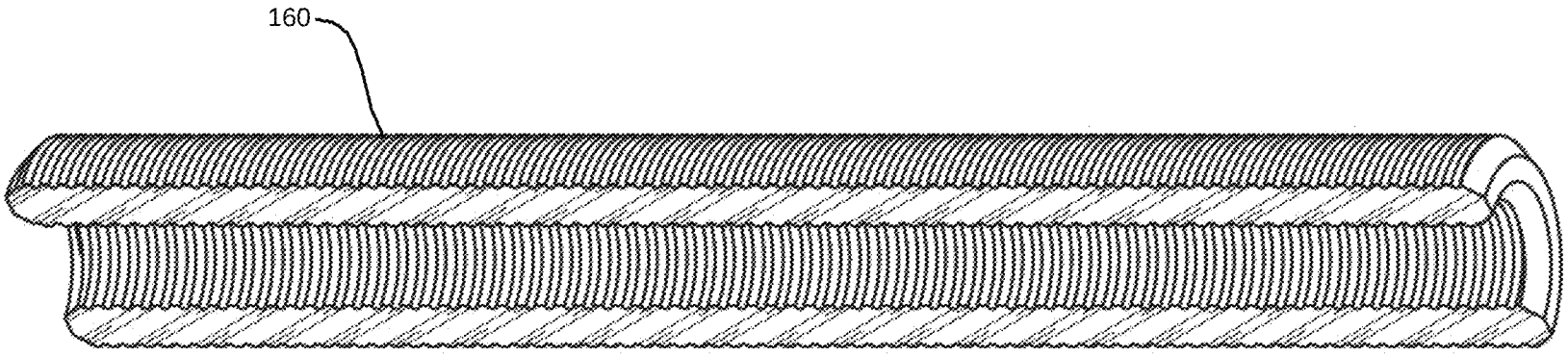
FIG. 9 is a perspective, cross-sectional view of a helically groove patterned packing element according to embodiments of the present disclosure.

FIG. 9 is a perspective, cross-sectional view of a helically groove patterned packing element 160 according to embodiments of the present disclosure. The element 160 is designed to leak fluid in a deliberate way. Instead of a conventional packing element that makes a seal on the hose, the leaky element 160 that allows the fluid to leak along a helical pathway can be used. Such an element 160 would impart a torsional load on the hose itself as the fluid winds around the helically cut grooves in the packing element 160. The ends of the element could be supported by axial thrust bearings so that the element as well as the hose inside it are free to spin together. A spinning hose is easier to push through a deflector shoe (dynamic friction+rotation may "unbind" a sinusoidally buckled hose) and a spinning hose will ensure the nozzles at the end of the hose directly impinge on more surface area because a rotating nozzle head causes the jet to sweep over more of the wellbore. This is an advantage because fewer but larger size nozzles can be used and still cover or hit the same amount of surface area as more but smaller nozzles.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

The invention claimed is:

1. An apparatus, comprising:

a flexible hose configured to be used in a jet drilling operation in a wellbore, the flexible hose having a nose;

a protective housing configured to encase and protect the flexible hose, the protective housing having a first interior diameter and a second interior diameter larger than the first interior diameter;

a packoff within the protective housing and surrounding the flexible hose;

a hose head assembly coupled to the flexible hose upward of the packoff, wherein the packoff seals around an exterior of the flexible hose; and a collet having an expandable portion movable from a retracted position in which the nose of the flexible hose cannot exit the collet and an expanded position in which the nose of the flexible hose is permitted to exit the collet, wherein the first interior diameter of the protective housing holds the expandable portion of the collet in the retracted position and the second interior diameter permits the collet to move to the expanded position, wherein during run in hole the collet is in the retracted position with the hose within the collet, wherein selectively applied pressure moves the collet to the expanded position and the hose is permitted to exit the collet, and wherein the hose head assembly is configured to selectively permit fluid pressure to enter the flexible hose.

2. The apparatus of claim 1 wherein the selectively applied pressure is fluid pressure applied to the interior of the flexible hose.

3. The apparatus of claim 1 wherein the selectively applied pressure is mechanical pressure causing a portion of the housing to contact a diverter shoe or other device in the wellbore that causes the collet to move to the expanded position.

4. The apparatus of claim 1 wherein the hose head assembly comprises:

an inner portion having a radial hole and being fluidly coupled to the flexible hose;

an outer portion coupled to the inner portion and having a corresponding radial hole, the outer portion being axially movable relative to the inner portion, wherein the radial holes of the outer portion and inner portion are movable into and out of alignment to permit or inhibit fluid from entering the inner portion;

a biasing member coupled between the inner portion and outer portion, the biasing member being configured to urge the radial holes into alignment.

5. The apparatus of claim 4 wherein the outer portion has a thickest outer diameter, wherein the apparatus also comprises a collar in the protective housing having an interior diameter slightly smaller than the thickest outer diameter, wherein when the thickest outer diameter of the outer portion reaches the collar the hose head assembly forms a seal between the collar and the thickest outer diameter.

6. The apparatus of claim 5 wherein the seal between the collar and the thickest outer diameter of the hose head assembly is configured to withstand some, but not all pressure applicable within the protective housing above the packoff, such that selectively increasing the pressure above a predetermined threshold will cause the radial holes to move out of alignment and to allow the pressure to urge the hose head assembly beyond the collar.

7. The apparatus of claim 6, further comprising a plurality of collars spaced apart at known distances, wherein measuring the pressure applied to the hose head assembly indicates a position of the hose head assembly and a rate of travel from collar to collar.

8. A method of running a flexible hose into a wellbore, comprising:

positioning a flexible hose in a wellbore within a packoff, wherein the packoff is within a housing, the flexible hose having a first portion above the packoff and a second portion below a packoff, the packoff forming a seal around an exterior of the flexible hose, wherein the housing comprises a hose retainer configured to release the hose axially when the hose retainer reaches a predetermined location in the well, wherein the first portion includes a hose head assembly having a selectively closable opening fluidly coupled to the flexible hose;

providing pressure to the first portion such that the flexible hose is moved down into the wellbore until the flexible hose reaches the predetermined location in the well, wherein if pressure is below a threshold, fluid is permitted to enter the flexible hose through the selectively closable opening, and if pressure is greater than the threshold pressure, the selectively closable opening is closed;

releasing the flexible hose from the hose retainer;

pumping fluid through the flexible hose; and selectively applying pressure to open or close the selectively closable opening.

9. The method of claim 8 wherein the predetermined location comprises a large diameter region that allows the hose retainer to expand radially to permit the hose to extend through the hose retainer.

10. The method of claim 8 wherein the housing comprises a collar having an interior diameter sufficiently small to form a seal with the hose head assembly as the hose head assembly reaches the collar, the seal being sufficiently weak that the seal is overcome by application of pressure above the threshold, the method comprising applying pressure sufficient to overcome the seal to urge the hose head assembly past the collar.

11. The method of claim 10 wherein the housing comprises a plurality of collars spaced apart axially in the wellbore at known distances between the collars, the method further comprising measuring pressure to determine when the hose head assembly reaches the collars and thereby measuring a position of the hose in the wellbore.

12. An apparatus, comprising:

a housing having a hose ejection site and a plurality of collars;

a hose assembly comprising:

a nose at a distal end;

a flexible body having an interior bore coupled to the nose;

a hose retainer being configured to release the nose from the hose retainer upon reaching the hose ejection site;

a packoff coupled to the flexible body and being configured to fit within the housing, the flexible body extending through the packoff;

a hose head assembly coupled to the flexible body at a proximal end, the hose head assembly comprising a selectively openable aperture that is biased into an open position in which fluid enters the hose head assembly and the flexible body;

wherein:

the hose head assembly has an outer diameter equal to an interior diameter of the collars, wherein the outer diameter forms a seal with the collars;

the seal causes the selectively openable aperture to close;

when the selectively openable aperture is closed, pressure is selectively applied to the hose head assembly sufficient to overcome the seal and to move the hose head assembly past the collars.

13. The apparatus of claim 12 wherein the hose ejection site comprises a diameter that permits the hose retainer to expand and release the nose.

14. The apparatus of claim 12 wherein the selectively openable aperture comprises an inner portion and an outer portion slidably coupled to the inner portion and a biasing member configured to urge the inner and outer portions into alignment to open the selectively openable aperture.

15. The apparatus of claim 12 wherein the collars are spaced apart by a predetermined distance, the apparatus further comprising a pressure monitor configured to monitor pressure that indicates when the seal is created, and from the times and the distances, the position and rate of movement of the hose head assembly may be determined.

16. The apparatus of claim 12 wherein the hose retainer comprises a collet with flexible fingers that expand upon reaching the hose ejection site.

17. The apparatus of claim 12 wherein the packoff comprises a labyrinth seal configured to permit a portion of fluid to flow through the seal while directing the remainder through the hose assembly.

18. The apparatus of claim 12 wherein the packoff comprises a helical seal configured to permit helical movement of the hose assembly when pressure is applied.

* * * * *